US005987662A

United States Patent [19]

Kiyokawa et al.

[11] Patent Number: 5,987,662

[45] Date of Patent: Nov. 23, 1999

[54] SAUNA DEVICE

[76] Inventors: Shin Kiyokawa; Taro Kiyokawa, both of 402, Bentencho, Sohka-shi, Saitama-ken, Japan

[21] Appl. No.: 08/977,692

[22] Filed: Nov. 24, 1997

[30] Foreign Application Priority Data

Apr. 2, 1997 [JP] Japan ..... 9-084176

[51] Int. Cl.[6] ..... A61H 33/06

[52] U.S. Cl. ..... 4/524

[58] Field of Search ..... 4/524–535

[56] References Cited

U.S. PATENT DOCUMENTS 5,546,678 8/1996 Dhaemers ..... 4/524 X

FOREIGN PATENT DOCUMENTS 0300577 1/1989 European Pat. Off. ..... 4/531

3728378 2/1988 Germany ..... 4/524

1079500 4/1986 Japan ..... 4/524

*Primary Examiner*—Charles E. Phillips

*Attorney, Agent, or Firm*—Nikaido, Marmelstein, Murray & Oram LLP

[57] ABSTRACT

A sauna device, which achieves the above object and can produce a sauna effect even at low temperatures, includes: a heating device installed on a ceiling surface of a sauna chamber, the heating device including a flat-plate heating body having a heat radiating surface, a suction port on one side of the heating body, a supply port on the other side, and a duct-shaped air heating chamber formed at the back of the heating body; wherein hot air heated in the air heating chamber is blown out of the supply port down to near a floor surface where it is reversed and circulated in the sauna chamber to be drawn into the suction port for reheating; wherein a heat radiating area of the heating device for radiating heat into the sauna chamber is about 30-70% of the area of the ceiling surface of the sauna chamber, and the hot air blown from the supply port has a velocity enough to be able to come close to the floor surface of the sauna chamber.

5 Claims, 4 Drawing Sheets

FIG. 8(A)
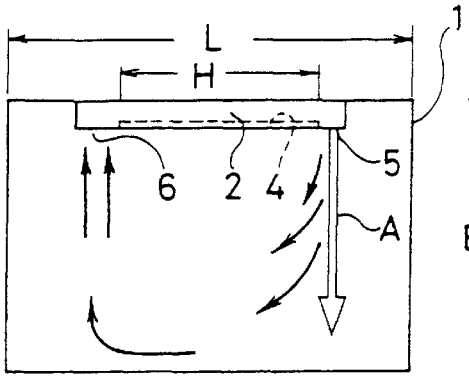
FIG. 8(B)
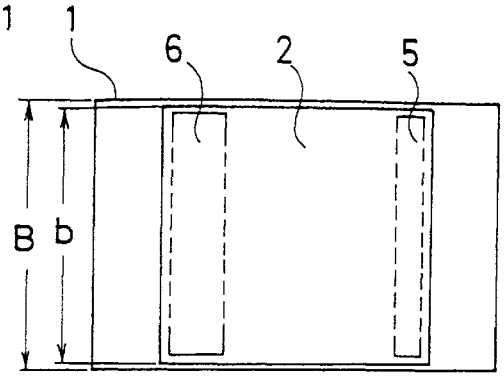
FIG. 9
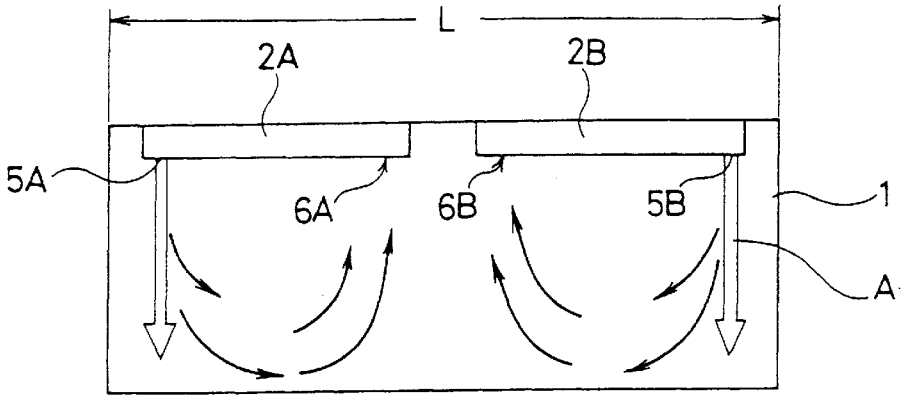
FIG. 10(A)
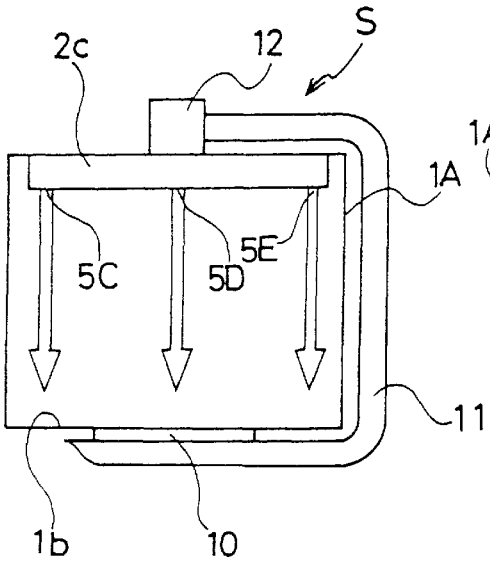
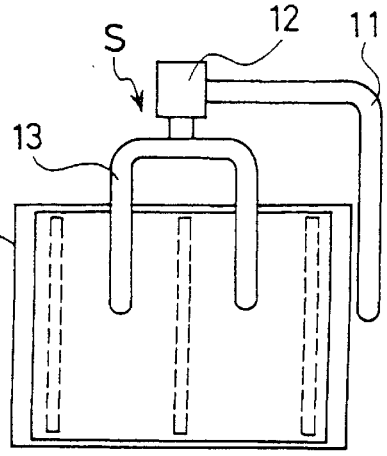
FIG. 10(B)

SAUNA DEVICE

TECHNICAL FIELD

The present invention relates to an improvement in a sauna device and provides a low-temperature sauna device that can stimulate perspiration from the user's body even at low temperatures compared with the temperatures at which a conventional sauna device is used, and can provide the user with refreshing sauna effects during and after the use.

BACKGROUND ART

A sauna bath that accommodates a large number of people at one time is generally called a "high-temperature sauna bath" which uses a red-hot heating body or an overheated steam heating body installed at a corner of a large sauna chamber to heat the chamber to high temperatures of 80–120° C., normally at around 100° C., thus properly heating the users sitting at locations sufficiently remote from the heating body (type A).

In recent years, a home-use small sauna device has been developed and is gradually beginning to be used. This kind of home sauna device normally uses a small far-infrared ray heating device that can be installed in a bathroom. The heating device includes a plurality of heating bodies having a circular heating surface and arranged at the top and bottom of the front surface of a box-like body of the heating device.

Further, another type that improves the heat efficiency of this home sauna device has a vertical duct provided at the back of the heating body-incorporated front surface to draw in heated air from the top of the duct and blow it out from below a chair on which the user is sitting, thereby enclosing the body of the user with hot air (type B).

In the case of the type-A large sauna bath, because the users receive radiant heat from the hot heating device, there are significant differences between the amounts of heat received by the users sitting at the front row and those at the rear. This naturally causes a large difference in the "sauna effect," the refreshing effect that stimulates perspiration and blood circulation to make users feel refreshed.

Because the users receive high-temperature radiant heat, they can stay in the sauna chamber for only a short period of time, from several to 20 minutes. To use this type of sauna bath requires the user to have a basic physical strength, and there are great variations in the sauna effect according to the physical strength of each user. The user who stay in the sauna for a short period cannot obtain a satisfactory sauna effect. Another disadvantage is that because a large space needs to be provided between the heating device and the users, a large chamber is required deteriorating the efficiency of space usage.

In the type-A large sauna bath, the user's body is subjected to high temperatures (for example, 80–120° C.) that are usually not experienced in daily life. Blood pressure is said to rise at high temperatures more than 70° C. and fall at temperatures below 60° C. although there are variations depending on physical strength. Hence, not only is the use of such a high-temperature sauna bath not recommendable for elderly people or persons with weak physical strength, it is dangerous from the viewpoint of health care.

Generally, elderly people often dislike bath and this makes the work of a person taking care of them more laborious. On the contrary, sun-bathing, necessary for people staying in bed, is recommended for many elderly people and sick persons who are in the process of recovering.

Hence, if a sauna device is available which provides temperature conditions close to that of sun-bathing and still stimulates perspiration like the conventional sauna bath, it can make the bathing more readily acceptable for the elderly or sick person by raising body temperature before taking bath. If the body can be dried naturally after bath, during which communication may take place among elderly and sick persons and nursing personnel, this not only is advantageous for elderly people but can greatly lighten the burdens of the nursing personnel.

The type-B home sauna device is a low-temperature sauna device far smaller than the large type-A sauna bath and has the advantage of being able to be installed at a corner of an ordinary home bathroom so that both the bath and the low-temperature sauna can be used.

Because the home sauna device naturally uses a small space, however, it mainly uses radiant heat radiated from the front of the device to heat the body and there are significant temperature differences between the side of the body that receives radiant heat and the opposite side. Hence, to produce the sauna effect uniformly over the entire body, the user must change his or her body orientation with respect to the heating body at appropriate intervals of time. Therefore, this type of home sauna device, though small and easily installable, cannot provide the sauna effect close to that of the large-size sauna bath to the user as he sits in a relaxed attitude for a long period.

The type-A large high-temperature sauna device has the drawback that it cannot be recommended to elderly or physically weak persons because of high chamber temperature and still requires a large sauna chamber, which degrades the efficiency of space usage. The type-B small low-temperature home sauna device has the drawback of not being able to transfer heat efficiently to the user's body. The inventor of this invention conducted studies to eliminate these drawbacks.

We have developed a device (type C) in which a heating device having a planar heating body is installed on the ceiling portion to supply and discharge hot air from both sides of the ceiling portion to cause the hot air to flow down in the sauna chamber toward the floor surface thereby efficiently heating the body of the user through heat radiation and through direct thermal transfer by contact of hot air to stimulate perspiration.

Another device similar to this type-C sauna device built into the ceiling is a so-called bathroom ventilating/drying device, which has a fan and a heating body installed in the ceiling of the bathroom to blow hot air from the ceiling into the bathroom to heat the interior of the bathroom or which simply exhausts air from the bathroom to use it as a drying compartment. This type of device has found a growing use in newly built condominiums (type D).

The bathroom ventilating/drying device of type D, like an ordinary air conditioner embedded in the ceiling, has a small-area heating body and a fan built into the ceiling. Hence, not only is the volume of air that can be supplied not so large, but the supply port and the suction port are arranged too close together. As a result, a so-called "short-circuit phenomenon" results, in which hot air blown out of the supply port is drawn into the suction port before it reaches the middle of the height of the bathroom.

Once the short-circuit phenomenon of hot air takes place, only the heated air near the bathroom ventilating/drying device or the ceiling portion of the bathroom is circulated, causing overheat of the heater, failing to dry the washing completely.

Further, the bathroom ventilating/drying device has a filter such as a net at the suction port, and dirt trapped by the filter grows into a lump with the elapse of time, which may fall into the hot air circulation duct to contact the heater and ignite, starting a fire. Therefore, the bathroom ventilating/drying device currently on the market has a risk of fire.

When the bathroom is used as a drying compartment by exhausting air from the bathroom, a narrow air passage is automatically formed which connects the air supply port at the bottom of the bathroom door and the bathroom ventilating/drying device. Once this air passage is formed, external air cannot be positively blown against the laundry hung in the bathroom, with the result that the laundry fails to be dried even after the exhaust fan has been operated more than half a day.

Measurements of temperatures along the height in the bathroom incorporating the bathroom ventilating/drying device have shown that the floor surface has the lowest temperature in the bathroom while the ceiling portion is kept at high temperature. The bathroom ventilating/drying device can produce only a small heating effect by which the temperature of air in the upper part of the bathroom near the ceiling is slightly raised. It is therefore out of question to use the bathroom as a small home sauna chamber.

Results of many experiments conducted by the inventors of this invention have found that the problem with the conventional sauna device is that it does not utilize the heat transfer by directly blowing hot air to the user's body.

When room-temperature air is heated to temperatures higher than 70° C.—the temperature that produces the sauna effect, the specific gravity of air decreases by as much as about 30–40%. The lower layer of air that does not reach the temperature at which the sauna effect is produced has a large specific gravity, while the upper layer of heated air is remarkably light.

It is therefore very difficult to blow hot air with a small specific gravity from the ceiling portion and causes it to flow down to or penetrate through an air layer near the floor surface to mix the high-temperature air and the low-temperature air. It is thus impossible to eliminate the large temperature difference that exists between the area close to the ceiling and the area close to the floor. Because the distance between the hot air supply port and the suction port in the bathroom drying device is relatively short, the hot air blown out of the supply port is easily short-circuited to the suction port, failing to heat the whole interior of the bathroom.

The inventor of this invention has long manufactured and marketed this type of sauna device and, based on this experience, developed the present invention by examining the problems with the conventional sauna devices of type A to type D.

It is an object of this invention to provide a sauna device which, though small in size, can produce an excellent sauna effect even for a user not familiar with sauna bath and which enables the user to efficiently use a narrow sauna chamber thereby producing a satisfactory sauna effect even at low temperatures of 40–65° C., preferably at around 50° C.

It is another object of this invention to provide a sauna device which gives the user a large amount of heat in a short period of time.

In the high-temperature sauna device, since the temperature is higher than 70° C., the chamber is extremely dry so that, if water is added, the chamber will necessarily remain dry.

In more concrete terms, the high-temperature sauna device at 100° C. can keep the humidity only at less than 1%, which is abnormally dry. In contrast to this, the low-temperature sauna device at 60° C. can control humidity to 40% at 60° C., 45% at 55° C., 50% at 50° C., 60% at 45° C. and 70% at 40° C.

High humidity in air means that air can hold an increased quantity of heat. As the heat quantity in air increases, the rate of heat transfer to body also increases. The quantity of heat given off to the body increases with the increased rate of heat transfer. This means that the increased heat quantity ensures a satisfactory sauna effect even at low temperatures.

Because a sufficient amount of heat can be imparted to the body through low-temperature air, the user no longer feels direct smarting heat rays on his skin, as experienced in the high-temperature sauna device, and can be warmed down to the core of his body in ways that are pleasant and soft to his body.

The present invention is intended to provide a sauna device that can supply a sufficiently large quantity of heat, even at low temperatures as mentioned above, to the user's body in a short period of time.

DISCLOSURE OF THE INVENTION

To achieve the above objectives, the sauna device of this invention has the following construction.

a) The sauna device comprises: a heating device installed on a ceiling surface of a sauna chamber, the heating device including a flat-plate heating body having a heat radiating surface, a suction port on one side of the heating body, a supply port on the other side, and a duct-shaped air heating chamber formed at the back of the heating body; wherein hot air heated in the air heating chamber is blown out of the supply port down to near a floor surface where it is reversed and circulated in the sauna chamber to be drawn into the suction port for reheating; wherein a heat radiating area of the heating device for radiating heat into the sauna chamber is about 20–80%, preferably 30–70%, of the area of the ceiling surface of the sauna chamber, and the hot air blown from the supply port has a velocity enough to be able to come close to the floor surface of the sauna chamber.

b) The sauna device also comprises: a heating device installed on a ceiling surface of a sauna chamber, the heating device including a flat-plate heating body having a heat radiating surface, a suction port on one side of the heating body, a supply port on the other side, and a duct-shaped air heating chamber formed at the back of the heating body; wherein hot air heated in the air heating chamber is blown out of the supply port at high speed to flow down to near a floor surface where it is reversed and circulated in the sauna chamber to be drawn into the suction port for reheating; wherein a heat radiating area of the heating device for radiating heat into the sauna chamber is about 20–80%, preferably 30–70%, of the area of the ceiling surface of the sauna chamber, and the velocity of the hot air blown from the supply port is increased to more than 5 m/sec, preferably 7 m/sec.

c) Further, the heating body of the heating device is controlled to temperatures higher than 1.5 times the average temperature of the sauna chamber.

This invention is characterized in that the volume and the velocity of hot air are increased so that the hot air blown from the heating device installed at the ceiling portion of the sauna chamber can reach the floor surface or penetrate into an air layer near the floor surface and that radian heat is radiated from the ceiling portion. The radiant heat is preferably radiated from as wide an area as about 30–70% of the planar area of the ceiling portion.

The speed of the heated air blown from the heating device needs to be more than 5 m/sec, preferably 7 m/sec.

In other respects, it is desired that a blower be operated to supply and discharge a volume of hot air equal to the volume of sauna chamber more than once every minute. The blower needs to have a sufficient performance to meet this requirement.

The hot air supplied from the heating device installed in the ceiling portion must come down close to the floor surface or preferably reach the floor surface. Because of the temperature difference between the hot air blown out and the sauna chamber, i.e., the difference in specific gravity of air, the hot air blowing from the ceiling portion may flow in directions in which there is less resistance against the downwardly penetrating flow (in directions toward the central part of the sauna chamber), resulting in a turbulent flow and forming many vortices, which in turn reduces the penetrating force of the hot air flow and makes it difficult for all the hot air to reach the floor surface.

In this invention, therefore, the state in which the hot air flows down in stream is expressed as "flows down close to the floor surface," meaning that not all the volume of hot air blown from the heating device penetrates through the air in the sauna chamber and reaches the floor surface but still the user in the sauna chamber can feel the hot air, is virtually heated and can enjoy the refreshing sauna effect that stimulates perspiration.

Compared with the conventional sauna device of a type which blows hot air from the ceiling portion or devices having the similar function, the sauna device of this invention is unique in blowing hot air at significantly higher speed and enclosing a main part of the user's body with the hot air to impart a large amount of heat to his body. Any techniques that can produce this effect belong to the technical scope of this invention.

The sauna device of this invention heats the body of the user to stimulate perspiration by the combination of the downwardly penetrating hot air flowing at high speed from the ceiling portion as described above and the radiant heat radiated from the radiation panel installed at the ceiling portion. Because the user's body can be wrapped by the hot air rapidly flowing down toward the floor, the heat transfer efficiency is extremely good so that the hot air, even if kept at low temperatures of about 50–60° C., preferably at 50° C., can heat the body swiftly and cause refreshing perspiration in a short period of time, for example, seven minutes.

The above temperature range is an inconceivably low temperature range not applicable in the conventional sauna device. In other words, in the conventional sauna device such a low temperature range represents an initial stage of warm-up and this shows how low the temperature of the hot air of this invention is.

Further, because it can keep the sauna chamber at a low temperature, the sauna device of this invention can be enjoyed for sauna effects by physically weak elderly persons and women. The device may also be used as an auxiliary helping means for rehabilitation and nursing for the sick and elderly. Experience of the inventors indicates that the optimum temperature range is 40–43° C.

BRIEF DESCRIPTION OF THE DRAWINGS

FIG. 8(A) is a front cross section of a sauna device similar to the one shown in FIG. 1 and FIG. 8(B) is a plan view of the same;

FIG. 9 is a front cross section of a sauna device having two heating devices installed in the ceiling surface; and FIG. 10(A) is a front cross section of a further sauna device and FIG. 10(B) is a plan view of the same.

BEST MODE FOR CARRYING OUT THE INVENTION

Now, embodiments of this invention will be described by referring to the accompanying drawings.

Figure 1:
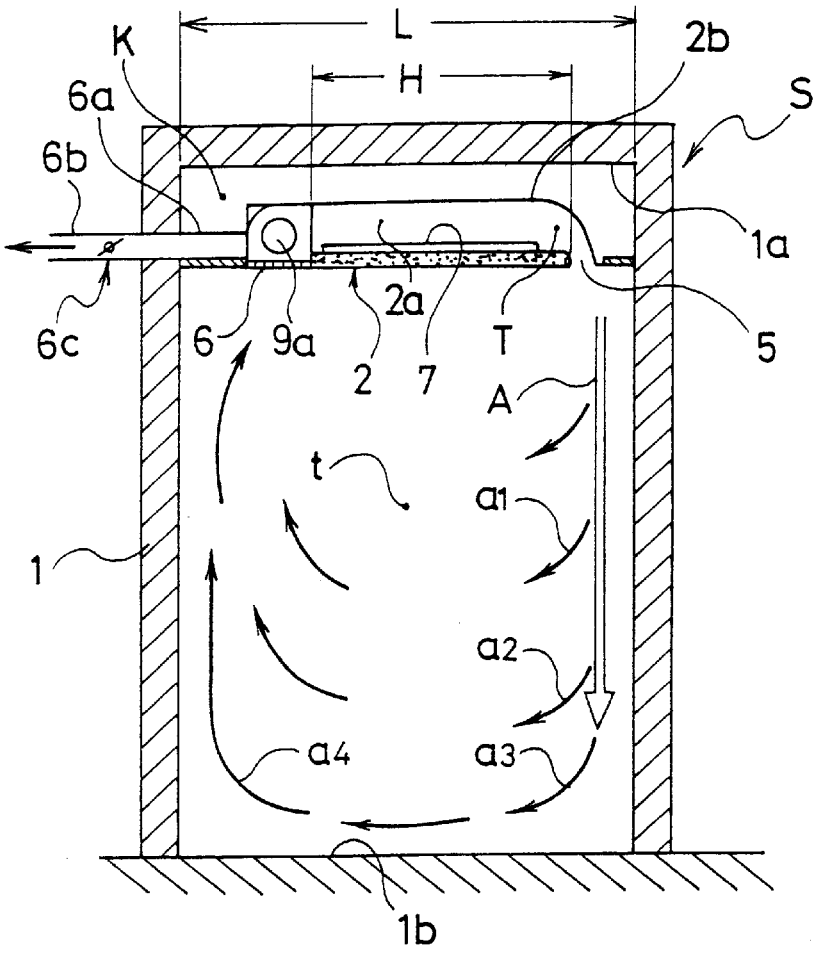
FIG. 1 is a front cross section showing the overall construction of the sauna device of this invention.
Figure 2:
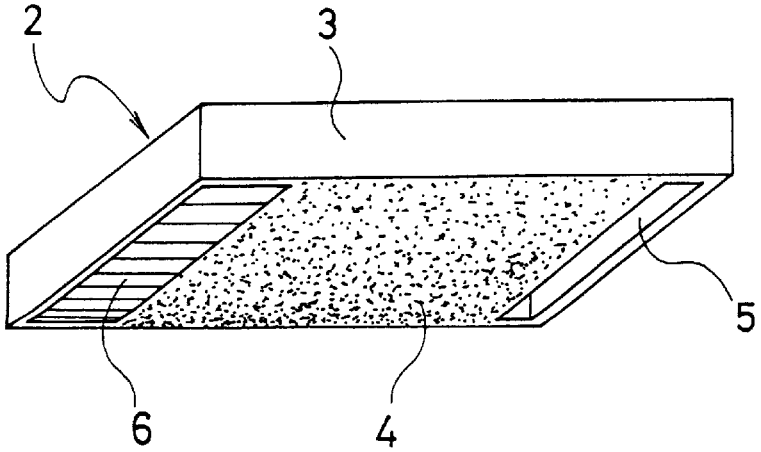
FIG. 2 is a perspective view of a heating device mounted in the ceiling surface as seen from below.

A sauna device S, as shown in FIG. 1, includes a sauna chamber 1 heat-insulated from the outside, and a heating device 2 mounted on a ceiling surface la of the sauna chamber 1.

The heating device 2, as shown in FIGS. 2 to 7, has formed at the underside of a casing 3 a radiation panel 4 which, when heated, radiates a large amount of far-infrared ray, a hot air supply port 5 provided at one end of the radiation panel 4, and a suction port 6 provided at the other end parallel to the hot air supply port 5 and adapted to draw in heated air that has gone down in the sauna chamber 1, reversed at or near the floor surface and circulated up to the ceiling portion.

Figure 3:
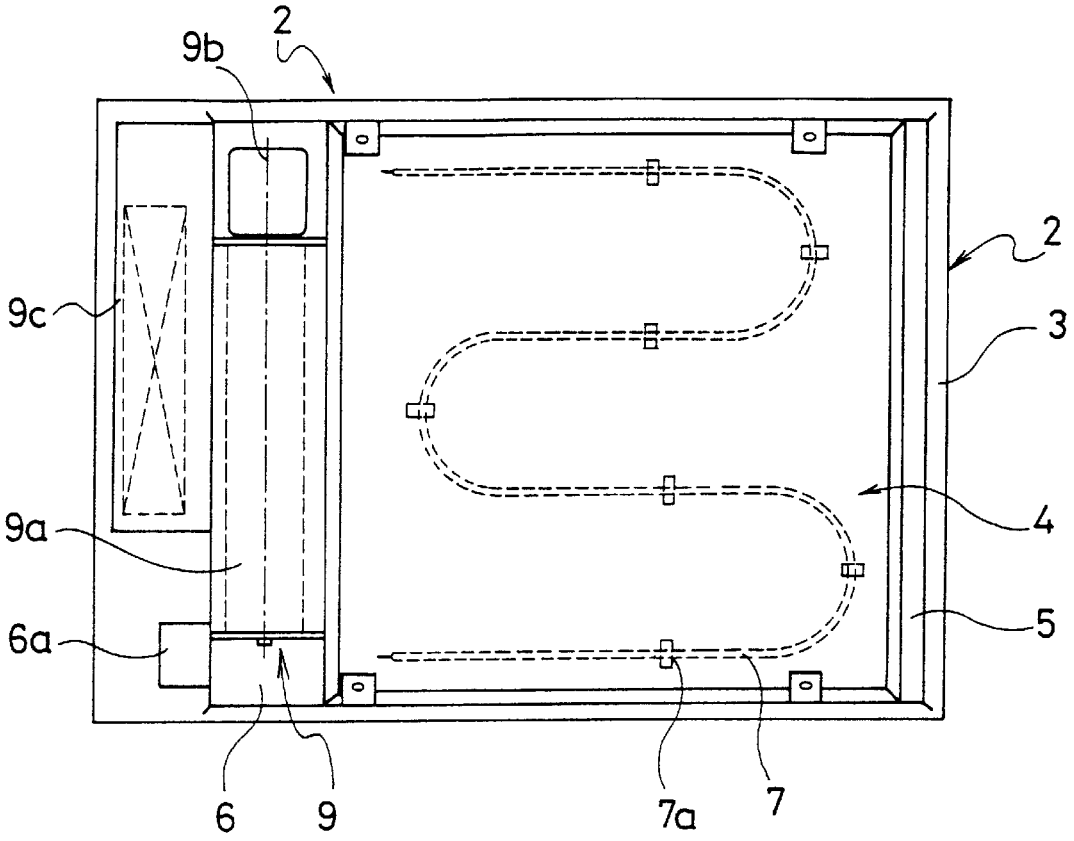
FIG. 3 is a front view showing one example of the heating device of FIG. 3 (as seen from below)
Figure 4:
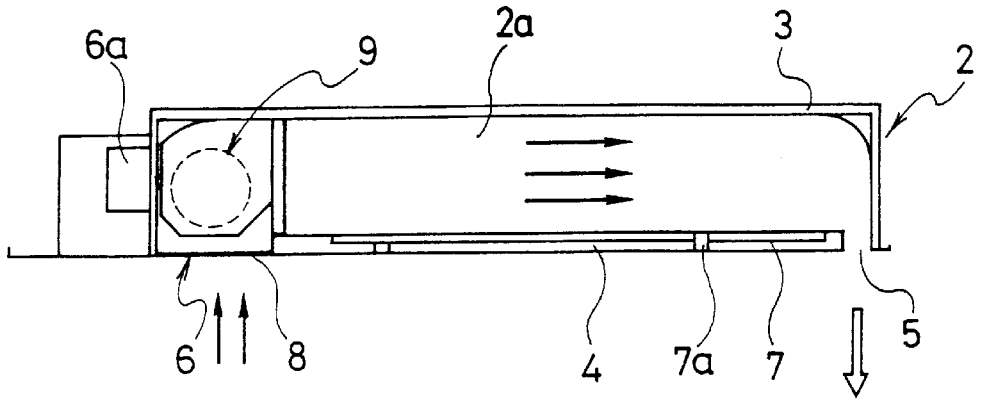
FIG. 4 is a side cross section of the heating device of FIG. 3.
Figure 6:
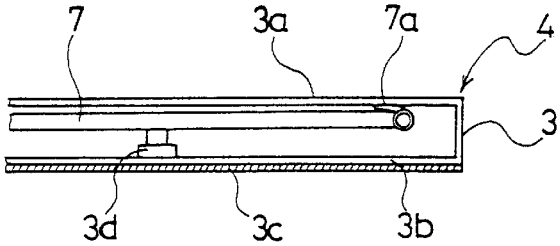
FIG. 6 is an essential-part cross section of a radiation panel built into the heating device.
Figure 7:
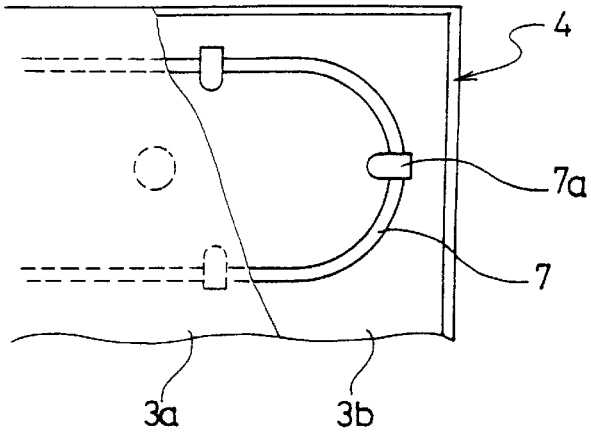
FIG. 7 is a partly cutaway front view of the radiation panel of FIG. 6.

The radiation panel 4, as shown in FIGS. 3 and 4, has a heater 7 (sheathed heater) arranged in a zigzag state on its upper surface and fixed with an appropriate number of clasps 7*a*. As shown in FIGS. 6 and 7, the radiation panel 4 is formed into a thin box constructed of an aluminum upper plate 3*a* and an aluminum lower plate 3*b*. The surface of the lower plate 3*b* is plasma-sprayed with ceramics, preferably aluminum oxide or titanium oxide, that radiates a great amount of far-infrared ray to form a thin ceramic layer 3*c*. Between the upper plate 3*a* and the lower plate 3*b* is installed a connecting member 3*d* that keeps these two metal plates a predetermined distance apart.

While this embodiment uses a sheathed heater as a heat source, other heat sources such as steam and gas may be employed.

The ceramics forming the ceramic layer 3*c* is chosen that produces an infrared ray having the wavelength that is easily absorbed by a human body, preferably about 8–10 $\mu$m.

As shown in FIG. 4, on the upper surface of the radiation panel 4 is formed an air heating chamber 2*a* that is shaped like a duct. A large volume of air drawn into this air heating chamber 2*a* by a fan 9*a* described later is heated by the heater 7 through heat transfer and radiation.

As shown in FIG. 1, between the ceiling surface 1*a* of the sauna chamber 1 and an upper surface 2*b* of the heating device 2 is formed a space K, in which a heat-resistant, inorganic heat insulation material such as glass fiber (not shown) is installed to prevent heat dissipation.

A filter 8 is attached to the suction port 6, as shown in FIGS. 1 to 4, and behind that filter a fan motor unit 9 is installed. The fan motor unit 9, as shown in FIG. 3, includes a fan 9*a* capable of delivering a large volume of air and a motor 9*b*, which is operated through a terminal box 9*c* arranged close to the fan motor unit 9.

The suction port 6 has an exhaust port 6*a* (exhaust pipe or exhaust duct), which is connected with an exhaust duct 6*b*, as shown in FIG. 1. A damper 6*c* installed in the exhaust duct 6*b* regulates the amount of air released from the sauna chamber 1 to control the pressure and humidity in the chamber.

The pressure in the sauna chamber 1 affects perspiration of human body. At the same body temperatures even a slight pressure reduction causes a sharp increase in the amount of aspiration and thus it is desired that the pressure in the sauna chamber 1 be controlled in the operation of the sauna device S.

While in this embodiment the suction port 6 is connected with the exhaust port 6*a* (exhaust duct), other configurations can also be employed. For example, the exhaust port 6*a* may be omitted.

When a bathroom is used as a sauna chamber with hot water of a predetermined temperature poured in a bathtub and if a sufficient amount of water vapor can be produced in the chamber and hot air can be supplied from the heating device 2 and circulated in the chamber to maintain an optimum temperature-humidity relation or balance, then an excellent sauna effect can be produced by which a sauna user is given a large amount of heat quickly even at low temperatures.

Further, if the sauna device of this invention is installed by the side of a shower room, the sauna user can feel even more refreshing by taking shower after sauna.

Examination of many embodiments implemented by the inventors of this invention has found that the sauna device S should best be designed under the following conditions.

1) Area of the Radiation Panel 4

The area of the radiation panel 4 forming the underside of the heating device 2 should be more than 20%, preferably 30–70%, of the area of the ceiling portion 1*a* of the sauna chamber 1.

Hence, when the width of the radiation panel 4 is set close to the width of the ceiling surface 1*a*, the length (H) of the radiation panel 4 will fall in the range of 30–70% of the length (L) of the ceiling surface 1*a*. The height from the floor of the sauna chamber 1 used in this invention to the underside (underside of the radiation panel 4) of the heating device 2 is 2440 mm.

The width of the radiation panel is more than about 30% of the width of the ceiling surface 1*a*, preferably in the range of about 70–95%.

The length of the heating device 2 (including the radiation panel 4, the supply port 5 and the suction port 6) is long enough so that hot air A flowing out of the supply port 5 located at one end of the radiation panel 4 is not virtually short-circuited, i.e., does not easily flow to the suction port 6 in a short path, but stays in the sauna chamber 1 as long as possible to release a sufficient amount of heat.

2) Air Velocity from Fan

The air flow from the fan 9*a* of the fan motor unit 9 constitutes an important element of this invention.

Figure 5:
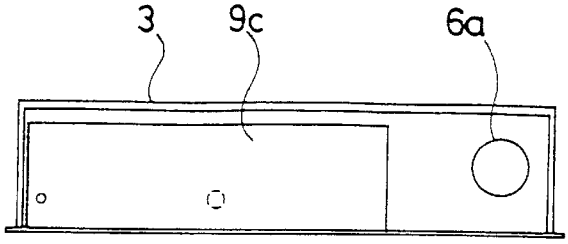
FIG. 5 is a left side view of FIG. 3.

The heating device 2 was designed so that the radiation panel is 490 mm long and wide, the suction port 6 180 mm wide, and the supply port 5 30 mm wide for example, as shown in FIGS. 3 to 5. Then measurements were taken of the height T mm between the floor surface 1*b* (FIG. 1) and the supply port 5 and of the velocity F m/sec of hot air coming out of the supply port 5. The relation between the height and the hot air velocity was as follows.

The air velocity F m/sec was 0.7, 0.81, 1.3, 1.52, 1.80 and 7.38 m/sec at the height T mm from the floor surface 1*b* of 100, 500, 1000, 1500, 2000 and 2400 mm, respectively.

When hot air was blown out from the supply port 5 at the velocity of 7.38 m/sec, the measured velocity at the height of 100 mm from the floor surface 1*b* was 0.7 m/sec, a significant reduction from the initial velocity. Hence, to obtain a reasonable air velocity down to a height near the floor surface 1*b*, it is seen that a large volume of hot air should be supplied at the initial speed of more than 7.0 m/sec or preferably more than 10.0 m/sec and circulated in the sauna chamber 1. It was also found that the fan capacity should preferably be 12 $m^3$/minute.

A stool may be used in the sauna chamber 1 and when the user sits on it and receives heat radiation from the radiation panel 4, the main part of the user's body is enclosed by hot air. In such a state, the hot air in a velocity range that assures good sauna effects without causing a short-circuit of hot air, even if it flows at more than 5.0 m/sec, allows the body of the user to be enveloped by hot air, producing a moderate sauna effect.

The path of hot air A blown out from the supply port 5 of the heating device 2 down toward the floor surface 1*b* is nearly as shown in FIG. 1. When the hot air A is blown close to the wall surface of the sauna chamber 1, it flow down toward the floor surface 1*b* as indicated by a thick arrow. Because there is no duct or guide plate for guiding the hot air A, a part of the hot air A branches as shown at $a_1$ and $a_2$ while flowing down. But the major part of the hot air flows along the floor surface 1*b* as indicated by $a_3$ and the branch streams of hot air $a_1$, $a_2$ merge into the rising stream $a_4$ of the main body of hot air $a_3$ and flow toward the suction port 6.

3) Temperature of Hot Air

The temperature of hot air A blowing from the supply port 5 of the heating device 2 is also an important consideration. To obtain a desired temperature of hot air A requires controlling the temperature T of the heater 7 installed behind the radiation panel 4. This temperature T needs to be more than two times, preferably about three times, the chamber temperature t. Although not shown in detail, temperature sensors are installed close to the floor surface 1*b* of the sauna chamber 1, at an intermediate portion of the wall surface, and at the ceiling portion. With these sensors, the temperature distribution in the sauna chamber 1 can be measured accurately.

As shown in FIGS. 3 and 4, air is supplied by the fan 9*a* to the back of the radiation panel 4 where it is heated to a predetermined temperature, and a large volume of hot air A heated in this way is fed into the sauna chamber 1. Because the air from the sauna chamber 1 is made to pass over the heater 7, the heater temperature is likely to fall.

It is therefore desired that while the temperature of the heater 7 is measured at a close distance, the velocity of hot air A blown from the supply port 5 be kept at more than 5 m/sec or preferably more than 7 m/sec and the current supply to the heater 7 be controlled to keep the temperature T of the heater 7 at more than two times the chamber temperature t.

Next, the relation between the sauna chamber 1 and the heating device 2 is explained.

FIG. 8(A) is a side cross section of the sauna chamber and FIG. 8(B) is a plan view of the same as seen from the ceiling side.

The relation between the length H of the radiation panel 4 of the heating device 2 and the length L of the sauna chamber 1 is H/L=30–70%. The width B of the sauna chamber 1 and the width b of the heating device 2 have the relation of b/B=70–95%.

The above H/L range represents a case where the width b of the radiation panel 4 is set almost equal to the width B of the sauna chamber 1. In practice, however, the H/L range needs to be determined by calculating the heat dissipating area of the radiation panel 4 so that the heat dissipating area will be 30–70% of the area of the ceiling portion.

The next important point is to set the supply port 5 and the suction port 6 as far apart as possible to avoid a short-circuit of hot air between them.

FIG. 9 shows a sauna device that has a plurality of heating devices 2A, 2B (in this embodiment two heating devices) in the ceiling portion of an elongate sauna chamber 1. When a plurality of heating devices 2A, 2B are to be used, it is preferred that the supply ports 5A, 5B be located at both sides of the sauna chamber 1 with the suction ports 6A, 6B located at the central part to avoid the short-circuit of hot air A—the fundamental philosophy of this invention. By forming the hot air circulation paths in this way, the whole interior space of the sauna chamber 1 can be heated to a predetermined temperature, assuring a good sauna effect.

FIGS. 10(A) and 10(B) show a sauna device S having another type of sauna chamber 1A. The heating device 2*c* installed in the ceiling portion has a plurality of supply ports 5C, 5D, 5E. Under the floor surface 1*b* is provided a wide suction port 10, which is connected through a duct 11 to a fan 12, whose delivery side is connected to the ceiling portion of the heating device 2*c*. The interior structure of the heating device 2*c*, though not shown, employs the one shown in FIGS. 3 to 5.

In the sauna device S shown in FIG. 10, because hot air is forcibly blown from the ceiling portion down to the floor surface 1*b* in only one way, the sauna device has the advantage of being able to maintain the whole interior of the sauna chamber 1A at a predetermined temperature.

As described earlier, it is known that the blood pressure rises when the body receives hot air at temperatures higher than 70° C. but does not rise so much when the temperature is below 60° C. To obtain as good a sauna effect as the conventional sauna bath even at such low temperatures, it is important to enclose the body with hot air as practically as possible. This invention can also be used for this application.

With this invention, when there is a sufficient volume of hot air at the air velocity described above in particular, a good sauna effect can be produced even at a low sauna chamber temperature of 40–56° C., preferably about 50° C.

Further, heating the body of an elderly or sick person in hospitals or nursing homes can be utilized very effectively as a preparatory step for taking bath. In that case, the sauna device of this invention can enclose the whole body of the elderly person with low-temperature hot air for heating so that he or she will feel refreshed. This may be followed by putting him in a bath. After the bath, the body can be dried naturally by this sauna device, eliminating the work of wiping his body. This invention can therefore produce an excellent sauna effect that can not be obtained with the conventional sauna device.

A recent finding has confirmed that, when a patient with stomach cancer was heated by radiation and hot air from the low-temperature sauna for recuperation, the cancer either stopped growing or was healed significantly.

Further, by constructing the sauna chamber 1 as shown in FIG. 1 so that it can be exhausted to a reduced pressure even slightly, perspiration can occur at lower temperatures.

The construction of this sauna device of this invention can be summarized as follows. The sauna device has a heating device installed in the ceiling portion of the sauna chamber. The heating device includes a flat-plate heating body having a heat radiating surface, a suction port on one side of the heating body, a supply port on the other side, and a duct-shaped air heating chamber formed at the back of this heating body. Hot air heated in the air heating chamber is blown out from the supply port down to near the floor surface where it is reversed and circulated in the sauna chamber to be drawn into the suction port for reheating. The heat radiating area of the heating device for radiating heat into the sauna chamber is about 30–70% of the area of the ceiling of the sauna chamber. The hot air blown from the supply port has a velocity enough to be able to come close to the floor surface of the sauna chamber.

Hence, the hot air from the heating device installed in the ceiling portion reaches almost the floor surface and the user in the sauna chamber is enclosed by heat radiation and hot air from the ceiling portion to receive a large quantity of heat. So, if the hot air is lower in temperature than an ordinary sauna device, the user's body can be heated properly in a short time to cause quick perspiration without consuming his or her physical strength, thereby providing the user with a refreshing sauna effect.

Further, by setting the hot air velocity in the range described in this specification, it is possible to enclose the user effectively with hot air and thereby heat the user's body through heat transfer by contact with hot air and through heat radiation from the ceiling portion, thus providing a good sauna effect.

When this invention is applied to a chamber having a means to produce water vapor like a bathroom, it is possible to cause the generated vapor to hold a large quantity of heat from the circulating hot air and thereby heat the user's body. Therefore, with this invention the user can receive a large quantity of heat that is inconceivable with the known sauna devices at low temperatures below 60° C., so that the user can efficiently heat his body.

Furthermore, the sauna device of this invention that uses low-temperature hot air for heating can be applied to a home bath and used as a heater for physically weak elderly people or infants.

What is claimed is:

1. A sauna device comprising:

a heating device installed on a ceiling surface of a sauna chamber, the heating device including a flat-plate heating body having a heat radiating surface, a suction port on one side of the heating body, a supply port on the other side, and a duct-shaped air heating chamber formed at the back of the heating body;

wherein hot air heated in the air heating chamber is blown out of the supply port down to near a floor surface where it is reversed and circulated in the sauna chamber to be drawn into the suction port for reheating;

wherein a heat radiating area of the heating device for radiating heat into the sauna chamber is about 30–70% of the area of the ceiling surface of the sauna chamber, and the hot air blown from the supply port has a velocity enough to be able to come close to the floor surface of the sauna chamber.

2. A sauna device according to claim 1, wherein the interior of a bathroom is heated by vapor generated by the heating device installed in the ceiling portion of the bathroom and by heated air and radiant heat from the heating device.

3. A sauna device according to claim 1, wherein the velocity and flow of hot air to be blown out from the heating device into the sauna chamber and circulated in the sauna chamber are so set as to supply and discharge a volume of hot air equal to the volume of the sauna chamber at least once every minute.

4. A sauna device according to claim 1, wherein the temperature of the heating body of the heating device is controlled to temperatures higher than two times the average temperature of the sauna chamber.

5. A sauna device comprising:

a heating device installed on a ceiling surface of a sauna chamber, the heating device including a flat-plate heating body having a heat radiating surface, a suction port on one side of the heating body, a supply port on the other side, and a duct-shaped air heating chamber formed at the back of the heating body;

wherein hot air heated in the air heating chamber is blown out of the supply port down to near a floor surface where it is reversed and circulated in the sauna chamber to be drawn into the suction port for reheating;

wherein a heat radiating area of the heating device for radiating heat into the sauna chamber is about 30–70% of the area of the ceiling surface of the sauna chamber, and the velocity of the hot air blown from the supply port is more than 5 m/sec.

* * * * *